US006196869B1

(12) United States Patent
Kay et al.

(10) Patent No.: US 6,196,869 B1
(45) Date of Patent: Mar. 6, 2001

(54) MOUNTING BRACKET AND POWER BUS FOR A CONNECTOR BLOCK

(75) Inventors: Jason Abraham Kay, Morristown, NJ (US); Ronald Marchisin, Toby Hanna, PA (US); Bassel Hage Daoud, Parsipanny, NJ (US); Raymond Paul Briggs, Newton, NJ (US); Peter F. Eckhardt, Gladstone, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/183,362

(22) Filed: Oct. 30, 1998

(51) Int. Cl.[7] ..... H01R 13/648; H01R 9/22; H01R 13/60; H01R 13/66

(52) U.S. Cl. ..... 439/532; 439/92; 439/96; 439/716

(58) Field of Search ..... 439/532, 96, 92, 439/716

(56) References Cited

U.S. PATENT DOCUMENTS

| | | | | |
|---|---|---|---|---|
| 3,491,267 | * | 1/1970 | Goshorn . | |
| 5,160,273 | * | 11/1992 | Carney | 439/108 |
| 5,595,507 | | 1/1997 | Braun et al. | 439/716 |
| 5,779,504 | * | 7/1998 | Dominiak et al. | 439/709 |

* cited by examiner

*Primary Examiner*—Paula Bradley
*Assistant Examiner*—Edwin A. Lpón
(74) *Attorney, Agent, or Firm*—Darby & Darby

(57) ABSTRACT

In a mounting bracket for a connector block of the type having an elongated wall and a plurality of spaced fingers extending therefrom, each of the fingers has a portion shaped to support the connector block. An insulation is provided along at least one surface of one or more of the fingers and a conductor is supported in spaced relation to the fingers upon or within the insulation. The conductor has an exposed contact at, below, or generally proximate the portion of the finger which supports the connector block. Also, the bracket may be used with a connector block of the type including a body and at least one end cap supported on the body. The end cap houses a plurality of terminals with conductive contacts extending therefrom into the body. A conductive power bus including a rail, a plurality of fingers, and a leaf-spring tail is coupled to the connector block, with the power bus positioned clear of electrical contact with the terminals or the conductive contacts. The power bus rail is seated within the connector block between the body and the end cap. The power bus fingers extend within the body from the rail and are positioned between the conductive contacts. The power bus leaf-spring tail extends external of the body. The mounting bracket and connector block cooperate to transfer power therebetween to energize subsystems such as protector circuits that may be coupled to the connector block.

9 Claims, 5 Drawing Sheets

MOUNTING BRACKET AND POWER BUS FOR A CONNECTOR BLOCK

FIELD OF THE INVENTION

The present invention relates to a mounting bracket for a telephone circuit connector block and, more particularly, to a connector block having an internal power bus which is energized upon mounting the connector block to a mounting bracket.

BACKGROUND OF THE INVENTION

Individual pairs of telephone circuit wires are frequently terminated in telephone company central offices, distribution cabinets and customer premise locations, for example, utilizing multi-terminal connector blocks, as is known in the art. Once terminated, these telephone circuit wires, usually comprised of cables containing narrow gauge insulated copper conductors, are grouped and then rerouted for appropriate distribution of the calls which they carry. Single connector blocks normally accommodate anywhere from 60 to 100 pairs of densely packed terminations, wherein multiple connector blocks are frequently contained in close proximity at a single location, e.g., one wall of a telephone switching room. Efficient utilization of mounting space is thus required since space within utility locations is traditionally at a premium.

Besides the incoming circuit terminations, the connector blocks are also utilized for making cross-connections between individual circuits on the connector blocks, as well as for mounting subsystems including test probes or current/voltage limiting circuit protectors which are used to prevent damage that may be caused by lightning, fallen power lines, or other external forces. For the most part, the terminations and cross-connections are made only at a front facing side of any connector block because the front area is the only area which is easily accessible. In addition, the circuit protection is also generally included at the front of the block, wherein grounding connections to establish a conduction path from the circuit protection to the mounting frame are required and accomplished, for example, by way of a ground bus connected to the mounting frame, such as the ground bus disclosed in U.S. Pat. No. 5,595,507 of Braun et al., assigned to the present assignee.

The many connections on the front face of a connector block make for a congested wiring arrangement. In order to energize a test probe or any active circuitry on a protector circuit, a power source must be made available at the connector blocks and provided to each such probe circuit. Complicating this issue is the fact that probes and protector circuits can be provided in pair-at-a-time or cartridge (multi-line) configurations.

Conventional protector circuits are passive insofar as they do not require a voltage source to drive their circuitry. Rather, such circuits react to over voltages or over currents in a given telephone line pair to affect a temporary disruption in service in response to a transient, or to permanently ground the line as a failsafe mode in response to a more extreme surge condition (e.g., by a lightning strike or dropped high-voltage power line).

In the event that the protector circuit is provided with an active component, such as an indicator as disclosed in co-pending U.S. Patent Application Ser. No. 09/183,368, filed concurrently herewith for "PROTECTOR CIRCUIT WITH LED FAILSAFE INDICATOR," then a high potential signal must be provided to the circuit to drive its components. Such active circuitry requires a separate power supply and/or a high-voltage line to the connector block at the mounting bracket. In either case, additional wiring is required which is generally undesirable in an environment in which hundreds of telephone lines are typically brought together.

What is needed in the art, and has heretofore not been available, is a power bus provided within a conventional connector and, further, a Z-type connector which includes such a high-voltage power bus. What is also needed in the art, and has heretofore not been available, is a bus bar provided on a connector block mounting frame for energizing circuitry associated with the wires and cables at the mounting frame.

SUMMARY OF THE INVENTION

In one illustrative embodiment of our invention a mounting bracket for a connector block of the type having an elongated wall is provided and a plurality of spaced fingers extend therefrom, with each of the fingers having a portion shaped to support the connector block. An insulation is provided along at least one surface of one or more of the fingers and a conductor is supported in spaced relation to the fingers upon or within the insulation. The conductor has an exposed contact at, below, or generally proximate the portion of the finger which supports the connector block. In preferred implementations, the insulation is provided on each of the fingers and the conductor is disposed within the insulation.

Another illustrative aspect Of our invention provides a connector block of the type including a body and at least one end cap supported on the body, wherein the end cap houses a plurality of terminals with conductive contacts extending therefrom into the body. A conductive power bus, including a rail, a plurality of fingers and a leaf-spring tail, is coupled to the connector block with the power bus positioned clear of electrical contact with the terminals or the conductive contacts. The power bus rail is seated within the connector block between the body and the end cap; the power bus fingers extend within the body from the rail and are positioned between the conductive contacts; and the power bus leaf-spring tail extends external of the body. In preferred implementations, the leaf-spring tail is normally biased away from the body, and the leaf-spring tail is generally proximate a fastener on the body, which fastener is shaped to engage a mounting bracket, such as the inventive mounting bracket described herein.

The invention may be embodied as a connector including a mounting bracket and a connector block which cooperate to transfer electrical signals therebetween. The mounting bracket supports a power line, and has taps at a plurality of contact points. The connector block includes a bus bar having a tail extending exteriorly thereof. The tail is positioned to engage the contact points of the mounting bracket and tap into the power line when the connector block is connected to the mounting bracket.

The invention also may be embodied as a combination of a mounting bracket and a connector block, with or without associated subcircuits such as protector and diagnostic circuits.

The inventive mounting bracket and connector block cooperate to transfer power or other signals therebetween, for example, to energize subsystems such as protector circuits that may be coupled to the connector block.

BRIEF DESCRIPTION OF THE FIGURES

These and other features and aspects of the invention are described more completely below in conjunction with the appended drawings wherein.

DETAILED DESCRIPTION OF A PREFERRED EMBODIMENT

By way of overview and introduction, the present invention is described in connection with a Z-type connector which is the presently preferred application. It is to be understood, however, that other forms of connectors can be used with equal advantage and facility with the present invention which is limited only by the claims appended hereto.

Figure 1:
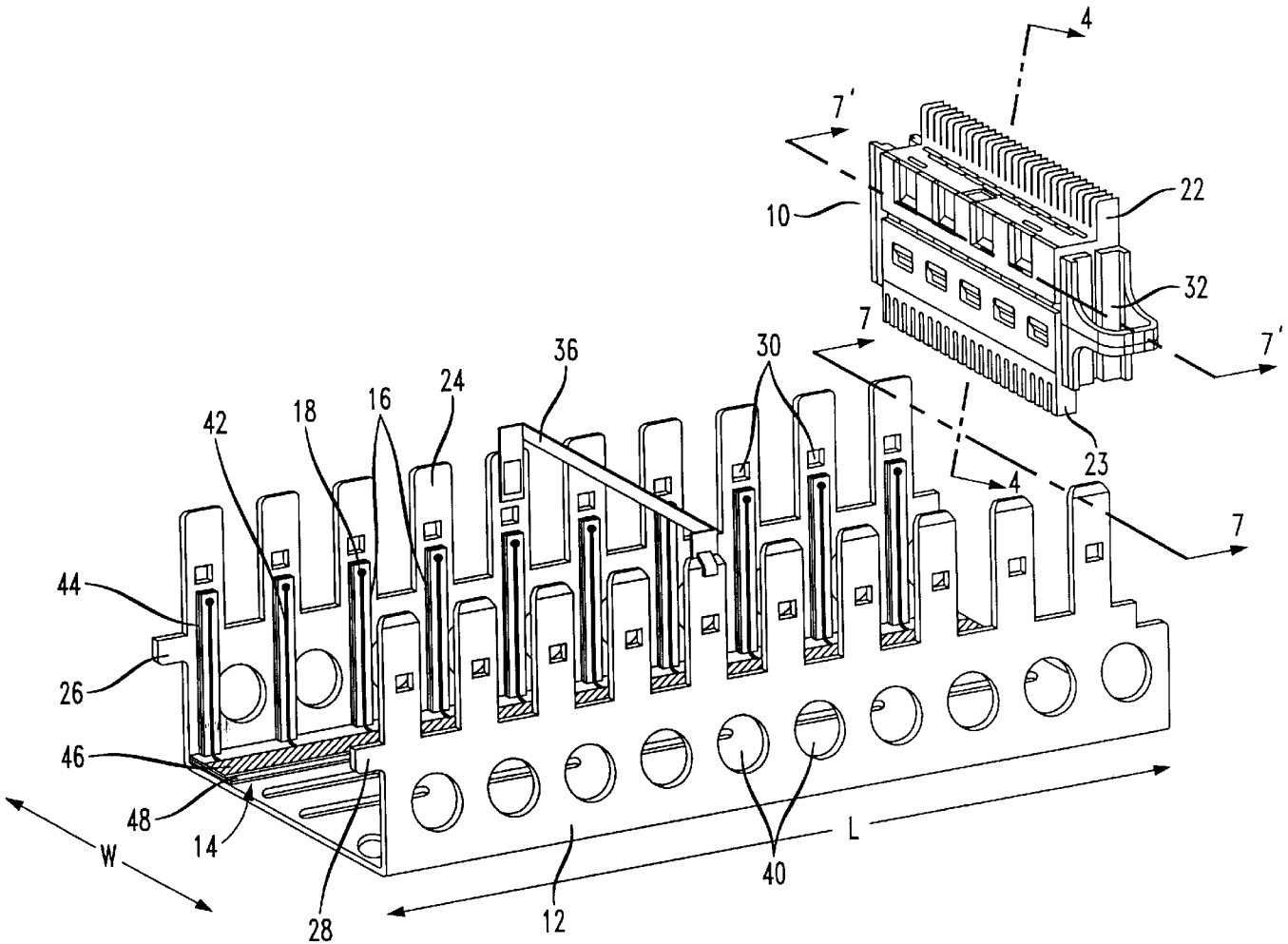
FIG. 1 is a perspective view of the mounting bracket and power bus combination according to one aspect of the present invention.

With reference now to FIG. 1, there is shown a connector block 10 in spaced relation to a mounting bracket 12, typically made of a rigid conductive material, for example, steel or aluminum. In a conventional manner, the mounting bracket is connected to a ground contact once attached to support structure (not shown). The connector block 10 is used, in a conventional manner, to terminate telephone circuit wires.

In accordance with one aspect of the present invention, a main bus 14 is supported on the mounting bracket 12 to provide a non-zero potential to the connector block 10, as described more fully below. Briefly, the power bus 14 includes fingers 16 which extend alongside the connector block 10 and terminate in a contact 18 which, in accordance with another aspect of the present invention, engages a bus bar 20 within the connector block 10.

Figure 7:
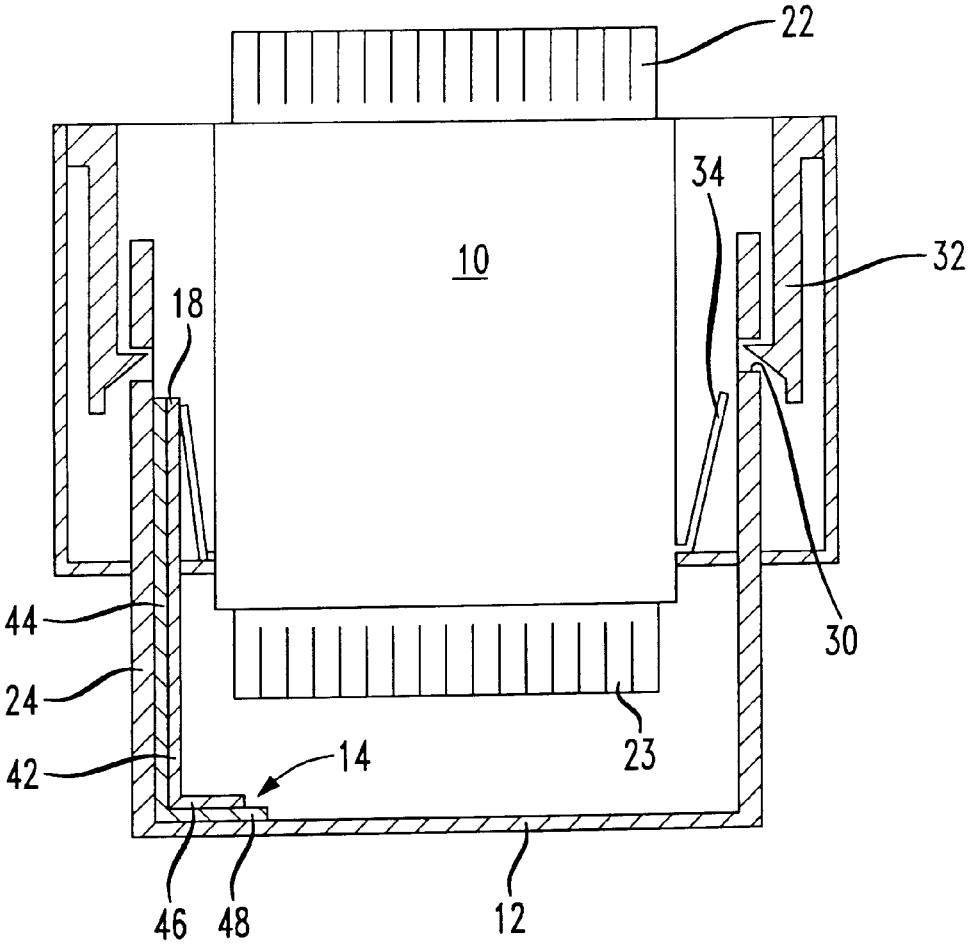
FIG. 7 is a cross-sectional view of the connector block mounted on the mounting bracket, taken along lines 7—7 and 7'—7' of FIG. 1.

The illustrated connector block 10 is a "Z" type connector block having end caps 22 facing in opposing directions. However, other connector blocks known in the art, including "U"-shaped connectors which have their end caps facing in the same direction, can be used with equal advantage and facility with the present invention. Regardless of the type of connector block used, one or more connector blocks 10 is insertable into the mounting bracket 12. The connector blocks are supported by posts 24 on either side of the bracket, the posts typically being connected to a ground potential. The fingers 16 of the power bus 14 are supported by the posts 24, yet the contact 18 is electrically isolated therefrom so that a non-zero potential can be transferred to the bus bar 20 of the connector block via a leaf-spring tail 34 which engages the bracket-supported contact 18 (FIG. 7).

The support posts 24 extend vertically upward and are oriented parallel to sides 26, 28 of the mounting bracket. In a preferred embodiment, the support posts 24 are generally thin rectangular members, wherein each of the support posts includes a rectangular opening 30 disposed centrally within the post. The openings 30 are adapted to receive a fastening tab 32 on the connector block 10 (see FIGS. 1 and 2) for securing the connector to the bracket 12. FIG. 1 also shows ground bar 36 which provides a ground path for circuit protection blocks which may be engaged to the connector block to protect a telephone line pair or a series of telephone line pairs. The ground bar 36 is adapted to couple to the posts 24 of the mounting bracket in a variety of orientations and to couple subsystems such as pair-at-a-time circuit protectors 38 or 66 (see FIGS. 4 and 6). Inclusion of circuit protectors, for example, is desirable in order to reduce the risk of damage from electrical surges to telephone equipment coupled to the connector block. Details of the ground bar 36 are described in U.S. Pat. No. 5,595,507 of Braun et al., assigned to the present assignee, which is incorporated in its entirety herein by reference.

At least one of the sides 26, 28 of the mounting bracket supports the fingers 16, which preferably extend generally parallel to the support posts 24. The fingers 16 include a conductor 42 which is supported in spaced relation from the bracket by an insulator 44. The conductor 42 is an electrically conductive material such as copper. The insulator 44 is preferably an insulative adhesive such as a double-backed foam tape or a spray which can be applied to the mounting bracket, but may comprise a conventional wire insulation. The conductor 42 of each finger 16 is electrically connected at one end to a longitudinally extending conductor 46, which is electrically isolated from the bracket by an insulator 48, which may be the same insulator as insulator 44. At its other end, the conductors 42 terminate at the contacts 18 which engage the leaf-spring tail 34 associated with each connector block (see FIG. 7). Together, the conductor/insulator pair 42, 44 on the fingers 16, and the longitudinally extending conductor/insulator pair 46, 48 define the comb-shaped power bus 14. Preferably, the insulators 44, 48 encase the conductors 42, 46 except at the contacts 18 to minimize the risks of shock and short circuits. The contacts 18 are generally proximate the rectangular openings 30 of the support posts 24. The contacts 18 are positioned so that they engage the leaf-spring tails 34 of the bus bars 20, if present, when the connector blocks 10 are installed in the mounting bracket 12.

The power bus 14 conveys a non-zero potential voltage to each of the fingers 16 from a voltage source which is remote from the mounting bracket 12, for example, a 48 V DC source on the premises which is used to power other telephone equipment at the same premises. This non-zero potential voltage is transferred from a stationary mounting bracket 12 to each connector block 10 attached thereto, and is accomplished by a straight-forward modification to a conventional mounting bracket 12, that is, without separate stamping or forming steps. In particular, the power bus 14 can be provided in accordance with a preferred mode of the invention by adhering an insulted, comb-shaped conductive pattern to at least one side of the mounting bracket and providing contacts 18 adjacent the connector block attachments (openings 30).

The bracket 12 and ground bar 36 are made from a rigid conductive material, for example, steel or aluminum. In a preferred embodiment of the invention, the mounting bracket has a width W of approximately four inches in order to be mountable on standardized cross-bars and bracketworks of the type used in electrical cabinets and utility areas. The length L of the bracket is determined by the number of terminations necessary to be accommodated, with brackets being available in many standard lengths to provide any number of terminations. In a preferred embodiment of the invention of the connector blocks 10 will be arranged on 0.9 inch centers, resulting in an overall length of nine inches for a 100 pair connecting block when ten pair connecting blocks are used. Apertures 40 are included on either side of the mounting bracket to facilitate cable insertion and dressing; however, other configurations of the mounting bracket 12 are within the scope of the instant invention if configured to deliver a non-ground potential voltage to a connector block connected thereto.

Figure 2:
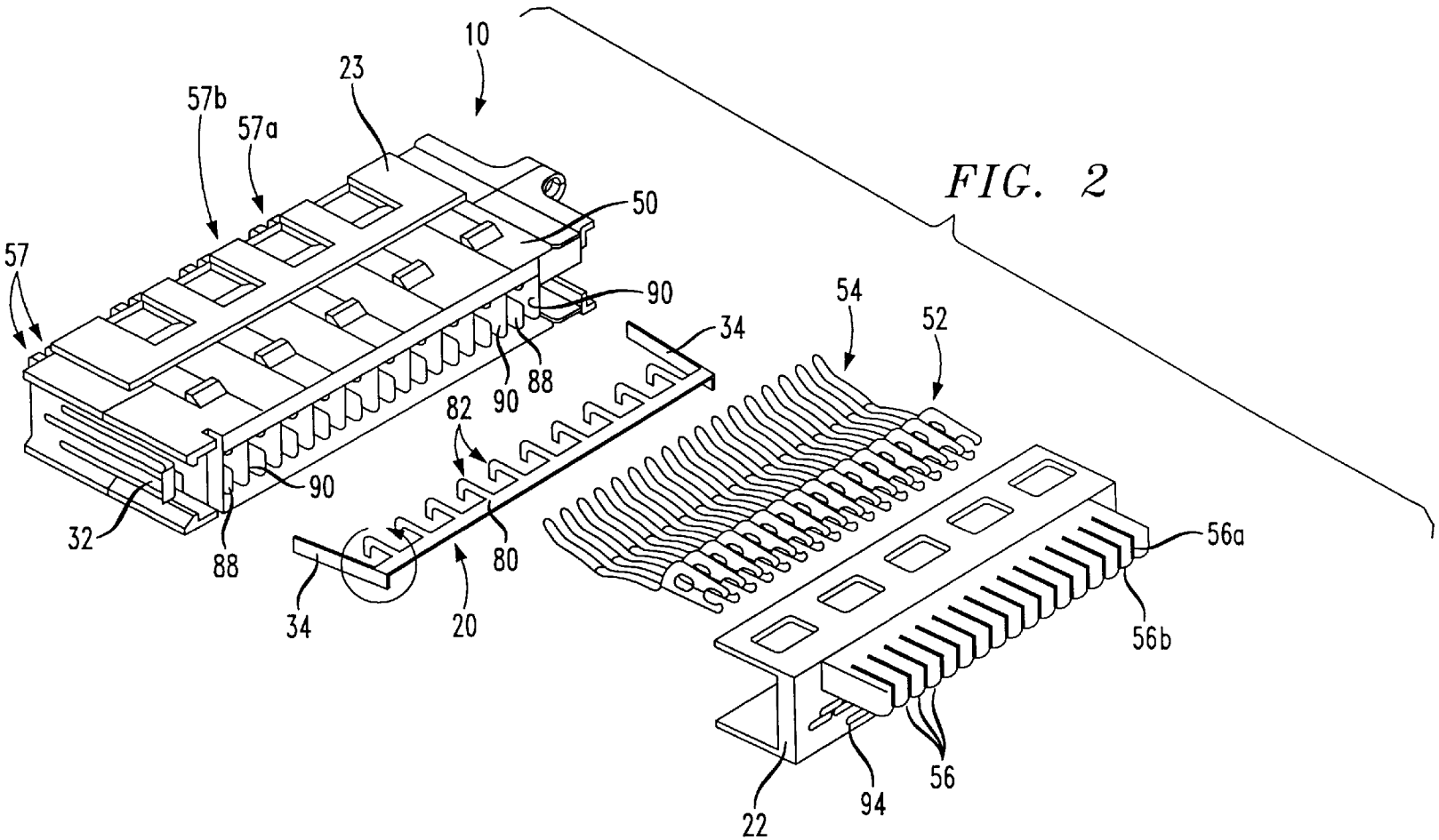
FIG. 2 is an exploded view of a connector block having a bus bar therein for insertion into and coupling to the power bus of the mounting bracket of FIG. 1, according to another aspect of the invention.

With reference now to FIG. 2, a further aspect of the instant invention is described. In FIG. 2 there is shown an exploded view of a connector block 10, with one end cap 22 shown in spaced relation to a body portion 50 and another end cap 23 shown attached to the body portion. In accordance with conventional connector block design, the body portion 50 houses a plurality of insulation displacement connectors ("IDCs") 52, each having a contact 54 extending therefrom. A corresponding set of IDCs and contacts extend from the end cap 23, but are not shown in FIG. 2. In a conventional manner, telephone wires are received at terminals 56, 57 and engaged by the IDCs 52. The IDCs strip away any insulation and establish both a mechanical and electrical contact with a communication wire. The communication wire enters the connector block 10 at one of the terminals 56, 57, is engaged by the IDCs 52 and is conveyed to the contacts 54 associated with the end cap which houses the other of the terminals 56, 57. The contacts associated with each end cap 22, 23 are normally biased to contact one another to convey signals between terminals 56 and 57 to continue a circuit across the connector block 10. For example, a communication circuit including a pair of wires or cables connected to terminals 56*a* and 56*b* would continue at the other side of the connector block 10 at terminals 57*a* and 57*b,* respectively.

In addition to these conventional elements, a bus bar 20 is provided between one or both of the end caps 22, 23 and the body portion 50 of the connector block 10. The bus bar 20 can supply a non-zero potential voltage to electrical subsystems that may be connected to the connector block (for example, a protector circuit, patch cord, a diagnostic circuit, or test probe). The bus bar 20 is secured in place between the end caps and the body. Only the leaf-spring tail 34 is external of the connector block 10 to engage the contact 18 of the power bus 14, as shown in FIG. 7.

Figure 3:
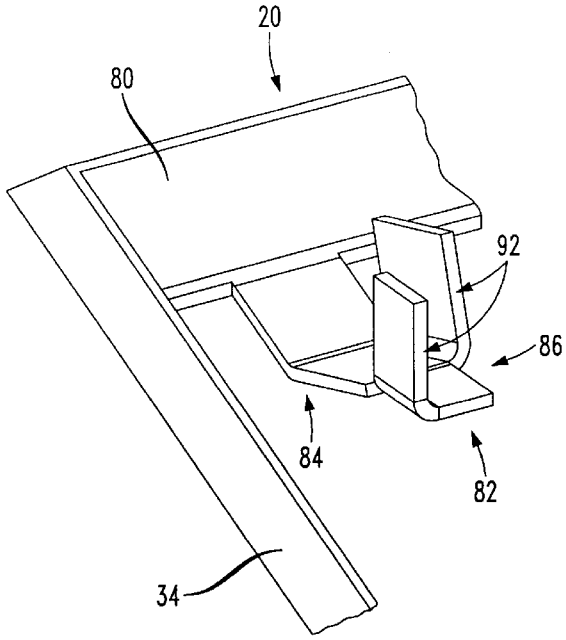
FIG. 3 is a detail view of a portion of the bus bar, taken along lines 3—3 of FIG. 2.

With reference now to FIG. 3, details of the power bus 20 are described. The power bus 20 includes an elongate, conductive rail 80 which is seated between the body 50 and one of the end caps 22, 23. The rail 80 is in parallel to, but spaced away from, the terminals 56, 57 so as to be clear of the IDCs 52 and contacts 54. A plurality of fingers 82 depend from the rail 80 within the body 50, and preferably extend generally perpendicular to the rail.

An enlarged view of one of the fingers is shown in FIG. 3. Each finger 82 has a spring portion 84 which extends from the rail 80 and terminates in a seat 86 which abuts an edge of a divider 88 within the connector block 10 (FIG. 2). The divider 88 separates two wires of a given telephone line pair, whereas the respective telephone wire pairs are isolated from each other by walls 90. The connector block 10 of FIG. 2, for example, houses ten telephone-line pairs, has ten dividers 88, and eleven walls 90. Each finger 82 further has a pair of stabilizers 92 which engage side walls of the divider 88. Together, the seat 86 and stabilizers 92 of each finger position the power bus 20 relative to the interior features of the body portion 50 of a conventional connector block.

At least the spring portion 84 of each finger 82 is in electrical contact with the rail 80 for conveying the non-zero potential thereto. Preferably, the power bus 20 comprises a single, metallic element which includes the leaf-spring tail 34, the rail 80 and fingers 82 (including spring portion 84, seat 86, and stabilizers 92). A unitary power bus 20 can be made by a progressive stamp and die process in which selected portions of a metallic substrate are removed and bent at successive metal-forming stations, each provided with suitable dies, to result in the arrangement shown and described herein.

Figure 4:
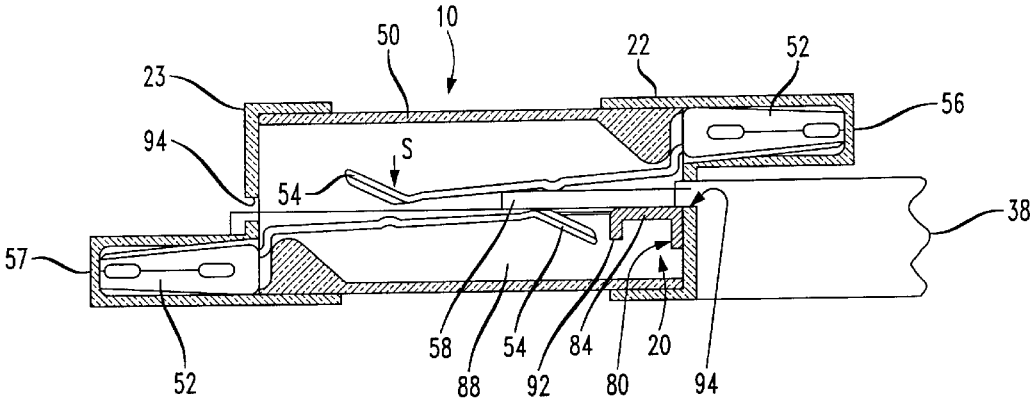
FIG. 4 is a cross-sectional view of the connector block, taken along lines 4—4 of FIG. 1, further showing a subsystem such as a protector circuit connected thereto.

With reference now to FIG. 4, an assembled connector block including the power bus 20 of the present invention is illustrated in cross-section. As perhaps best seen in that figure, the power bus 20 is seated between the end cap 22 and the body 50, wherein the spring portion 84 of the finger 82 contacts a printed circuit board (PCB) 58 of a subsystem 38 which has been inserted into the connector block through slot 94. The subsystem may be a protector circuit, patch cord, a diagnostic circuit, or test probe. The natural bias of the spring portion 84 away from the divider 88 ensures good electrical contact between the power bus 20 and the PCB 58. FIG. 4 also illustrates one of the braces 92 in abutting contact with the divider 88 and illustrates the spring 84 arching away from the divider 88.

Figure 5:
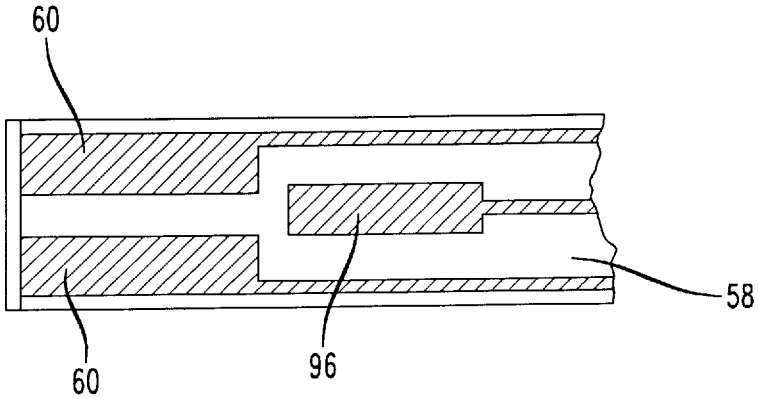
FIG. 5 is a top plan view of a portion of a circuit board of a subsystem that may be inserted into the connector block of FIG. 2.

In a conventional manner, the subsystem 38 includes a printed circuit board 58 which engages the pair of contacts 54 which are associated with a particular telephone-line pair. For example, the conductors 60 shown in FIG. 5 are printed in the same position on both sides of the PCB 58 (only one side shown) and arranged to engage the contacts 54, for example, between terminals 56*a,* 57*a* and 56*b,* 57*b,* respectively, of one telephone-line pair. The subsystem 38 in FIG. 4 may be a cartridge-type accessory which spans several telephone line pairs, or may be a single terminal pair subsystem (also known as a "pair-at-a-time") which affects only one telephone line pair. The PCB 58 of FIG. 5 is illustrated as having conventional conductor contacts 60 which engage the respective wires of a telephone line pair, and further has a conductor contact 96 for conveying the non-zero potential voltage from the power bus 20 to the subsystem 38. Such a PCB which has this third contact pad is described more fully in U.S. Patent Application Ser. No. 09/183,368, filed concurrently herewith, for "PROTECTOR CIRCUIT WITH LED FAIL SAFE INDICATOR," assigned to the present assignee and incorporated herein by reference as if set forth in its entirety herein.

Referring again to FIG. 4, the subsystem 38 is inserted through the slot 94 into the connector block 10, wherein the conductors 60 make contact with both the front and rear terminals 56, 57 of the connector block via the contacts 54. Insertion of the subsystem 38 causes a separation S between the contacts 56 of the front and back terminals 56, 57 so that the current (telephone signal) is forced through the subsystem 38. In other words, the subsystem is in series with each telephone-line pair to which it is connected. When the subsystem is a protector, the series-connected protector circuit protects telephone lines from excessive voltages or currents that may be caused by outside disturbances, such as lightning or fallen power lines. Advantageously, the protector is utilized with the ground bar 36 to provide a discharge path to the mounting bracket 12 and is coupled to the ground bar when inserted into the connector block 10, as described next.

Figure 6:
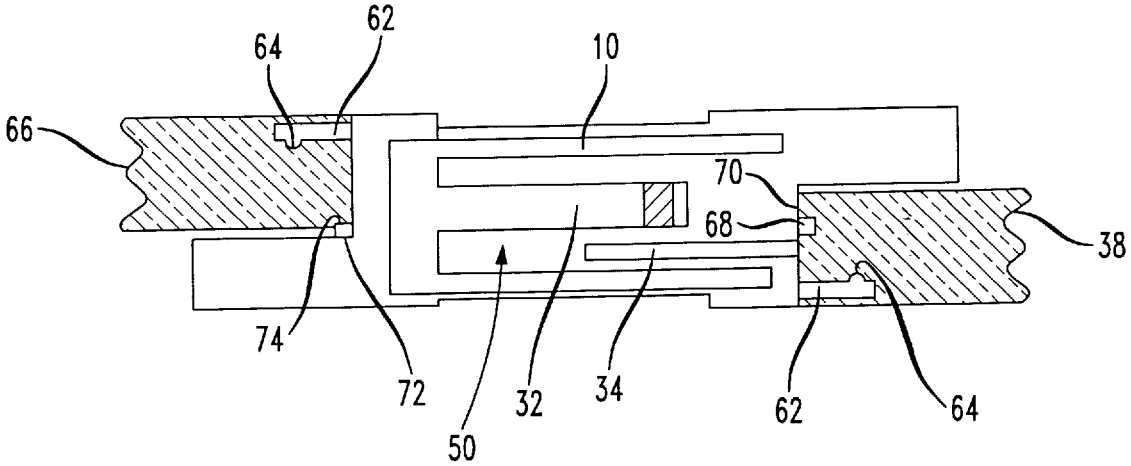
FIG. 6 is a side plan view of the connector block of FIG. 4, now showing subsystems connected at both ends of the connector block.

FIG. 6 is a side plan view of the connector block of FIG. 4 and illustrates further features of a connector block having the inventive power bus 20. In particular, the leaf-spring tail 34 is shown extending along the side of the body 50 of the connector block 10, and is preferably biased to normally extend away from the body from its point of emergence below the end cap 22 at an acute angle relative to the body. The leaf-spring tail 34 is generally proximate (for example, beneath) the fastening tab 32 so that engagement of the connector block 10 to the mounting bracket 12 causes the leaf-spring 34 to simultaneously engage the contact 18 of the power bus 14. In this way, the good electrical contact is made between the power bus 14 of the mounting bracket and the bus bar 20 of the connector block 10 (see FIG. 7).

The connector block has a cavity 62 that is adapted to receive and mate with the ground bar 36 to thereby establish a ground path for the subsystem 38, for example, an electrical discharge path for a protector circuit. The ground bar 36 as shown is designed to fit over the connector block 10 and positively seat itself via rounded protrusions 64, as described in the aforesaid U.S. Pat. No. 5,595,507. FIG. 6 also illustrates an exclusionary feature included on the connector blocks 10 to ensure proper polarity insertion of the protection blocks 38, 66. A key 68 and slot 70 system are shown within the interior of an individual subsystem 38 which is to be installed on the front of a connector block. Another corresponding key 72 and slot 74 are disposed at one end of an individual subsystem 66 which is to be installed in the rear of a connector block 10. The exclusion feature ensures that current and voltage limiting protector units cannot be installed in the wrong orientation.

To accommodate over voltages, for example, known protector circuits are provided with a path to ground in the event of an overload condition, for example, through ground bar 36. By including the bus bar 20, a non-ground potential can be provided to the protector circuit (via contact 96 (FIG. 5) on the PCB 58 to drive active circuitry associated with such a circuit or other subsystem such as a diagnostic circuit or patch cord.

FIG. 7 illustrates a connector comprising the connector block 10 mounted within the mounting frame 12. The mounting frame 12 provides signals (e.g., power) on a main bus 14. Signals are conveyed by conductor 46 to the conductors 42 associated with each support post 24. The connector block 10 is mounted to the support post 24, and is securely seated by the engagement of the fastening tabs 32 of the connector block within the openings 30 of the mounting bracket. In comparison to the exploded view of FIG. 1, the cross-sectional view of FIG. 7 is taken along lines 7—7 and 7'—7' wherein the connector 10 is thus shown seated within the mounting frame 12. The connector block 10 includes the bus bar 20, to which the signals are transferred from the mounting bracket. Specifically, as shown in FIG. 7, the leaf-spring tail 34 of the bus bar 20 extends exteriorly of the connector block 10 and engages the contact 18 to thereby tap the signal being conveyed on the main bus 14.

In use, a non-zero voltage is provided via power bus 14 to each of the fingers 16 for transfer of power between contacts 18 of fingers 16 and the leaf spring 34 to the bus bar 20 in connector block 10 (FIG. 7). The bus bar 20 conveys the non-zero voltage to a subsystem 38 by way of the PCB 58, for example a protector circuit. Such a voltage can be used, for example, to illuminate an LED when a protector circuit has tripped and shorted a telephone line pair to ground (for example, in a failsafe protection mode) as disclosed in the aforesaid co-pending patent application. In such an event, an LED is illuminated, for example, because a path to ground is conventionally available (for shunting the overload signal) to the protector circuit and because a non-zero or driving voltage is now available via the bus bar 20 of the instant invention. Thus, active circuitry is driven by a simple plug-in connection of a subsystem 38 to the connector block without having to connect extra wires or provide a separate power source.

Of course, the invention is not limited to illuminating LEDs on a protector circuit. The bus bar 20 can be used with equal advantage to energize other components and accessory circuits that may be used in connection with telephony or other circuits.

Voltage and current protection in the form of the gas tube or solid state protector circuits 38, 66 used in conjunction with the ground bar 36 are easily mountable to the connector block having the inventive bus bar 20. By implementing the cable terminations and the circuit protection at the rear of the connector block 10, for example, terminals 56 on the front of the connector block remain free for cross-connections and allow access for any testing procedures that need to be performed, with power for the test circuitry being available through the connector block 10 via the bus bar 20. Testing of any of the connections is further facilitated in that the connector blocks 10 are adapted to receive a test plug at the front or rear of the blocks through slot 94 to perform testing at any of the terminals 56, 57, both in an out of the circuit, without removal of the circuit protection or terminations, and without the need for a separate power supply or loose wires carrying a non-zero voltage.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined in the appended claims.

We claim:

1. A mounting bracket for a connector block, comprising:

a conductive bracket having an elongated wall and a plurality of spaced fingers extending therefrom, each finger having a portion shaped to support the connector block thereon;

insulation disposed along one surface of at least one of the fingers; and a conductor supported in spaced relation to the fingers upon or within the insulation so that the conductor is electrically insulated from the conductive bracket, the conductor having an exposed contact generally proximate the portion of the finger that is shaped to support the connector block, said exposed contact being positioned to establish electrical contact with and provide electrical power to the connector block from said conductor.

2. The mounting bracket as in claim 1, wherein the insulation is provided on each of the fingers.

3. The mounting bracket as in claim 1, wherein the conductor is disposed within the insulation.

4. The mounting bracket as in claim 1, wherein the insulation and the conductor are comb-shaped.

5. The mounting bracket as in claim 1, wherein the insulation is one of foam backed tape and an adhesive spray.

6. In combination with a connector block, a mounting bracket comprising:

an elongated wall;

a plurality of spaced fingers extending from the wall, each finger having a portion shaped to support the connector block thereon;

insulation disposed along one surface of at least one of the fingers; and a conductor supported in spaced relation to the fingers upon or within the insulation so that the conductor is electrically insulated from the mounting bracket, the conductor having an exposed contact generally proximate the portion of the finger that is shaped to support the connector block, said exposed contact being positioned to establish electrical contact with and provide electrical power to the connector block from said conductor.

7. The combination as in claim 6, wherein the mounting bracket is conductive, the mounting bracket further supporting one or more ground bars at locations which are clear of said contact points.

8. The combination as in claim 6, further comprising a protector circuit connected to the connector block.

9. The combination as in claim 6, further comprising circuitry connected to the connector block, the circuitry being selected from the group of a test probe, a patch cord, and a diagnostic circuit.

* * * * *

UNITED STATES PATENT AND TRADEMARK OFFICE

CERTIFICATE OF CORRECTION

PATENT NO. : 6,196,869 B1
DATED : March 6, 2001
INVENTOR(S) : Jason Abraham Kay et al.

It is certified that error appears in the above-identified patent and that said Letters Patent is hereby corrected as shown below:

Title page,
Item [75], Inventor change "Raymond Paul Briggs" to -- Paul Raymond Briggs --.

Signed and Sealed this

Second Day of October, 2001

*Attest:*

Nicholas P. Godici

*Attesting Officer*

NICHOLAS P. GODICI
*Acting Director of the United States Patent and Trademark Office*